United States Patent [19]

Vaughn

[11] Patent Number: 4,699,381

[45] Date of Patent: Oct. 13, 1987

[54] TABLE FOR PLAYING MARBLE GAME

[76] Inventor: Steve Vaughn, 3604 W. 6th St., Coffeyville, Kans. 67337

[21] Appl. No.: 831,827

[22] Filed: Feb. 24, 1986

[51] Int. Cl.[4] ..... A63F 7/00; A63D 15/00

[52] U.S. Cl. ..... 273/118 R; 273/11 C

[58] Field of Search ..... 273/121, 122 R, 125 R, 273/118 R, 113, 127 C, 108, 85 R, 11 R, 11 C

[56] References Cited

U.S. PATENT DOCUMENTS

| | | | |
|---|---|---|---|
| 2,639,151 | 5/1953 | Kennon | 273/118 R |
| 3,658,328 | 4/1972 | Kooker | 273/11 R |
| 4,549,737 | 10/1985 | Seyer et al. | 273/118 R |

*Primary Examiner*—Richard C. Pinkham
*Assistant Examiner*—Gary Jackson
*Attorney, Agent, or Firm*—Head & Johnson

[57] ABSTRACT

A table for playing marble games thereon employing target marbles of diameter X and one or more taws of diameter Y wherein Y is greater than X, the table having a base supporting a circular horizontal playing board, a circular horizontal top ring supported concentrically above the playing board and of an interior diameter less than the diameter of the playing board and of an exterior diameter greater than the playing board, the lower surface of the top ring being spaced above the top surface of the playing board a distance greater than X and less than Y providing a circumferential slot, a marble guide supported below the playing board and providing a generally frustoconical configured downwardly inclined upper surface to a central opening so that target marbles passing through the circumferential slot roll downwardly on the marble guide and out the central opening to a marble collection box positioned below the marble guide central opening for receiving the target marbles whereby they may be recovered for replay.

3 Claims, 3 Drawing Figures

TABLE FOR PLAYING MARBLE GAME

SUMMARY OF THE INVENTION

A game commonly played by youth, and especially boys, is called "marbles". In the typical game a circle outline is drawn on flat smooth ground. A number of target marbles, usually made of glass, are placed in the center of the circle and each player shoots, with his thumb, from outside the circle using shooters or taws, the object being to shoot the taw to strike a target marble and knock it out of the ring. While the game of marbles may be played in a variety of ways, one way is that the player who knocks the most marbles out of the ring wins. Another type of game can be played wherein each player puts in so many marbles identified as his, such as by color, and the first player to knock all of his opponent's marbles out of the ring prevails.

The present invention is directed towards an apparatus for adapting the old game of marbles for playing indoors. Others have suggested apparatus for playing marble games indoors and reference may be had to the following U.S. Pat. Nos. 2,639,151, 2,621,931, 2,943,858, 3,526,404, 4,445,690 and 4,445,689.

The present invention overcomes problems and limitations with the prior art, exemplified by these prior issued U.S. patents, and provides an improved table for playing marble games employing target marbles of a given diameter X, such as ½ inch and shooters or taws of a larger diameter Y, such as ¾ inch. The table includes a base for resting on a support surface or floor, the base having a horizontal top surface. A circular horizontal playing board is supported on the base top surface and provides an upper playing surface. A circular, horizontal top ring is supported concentrically above the playing board. The ring is of an interior diameter less than the diameter of the circular playing board and of an exterior diameter greater than that of the playing board. The top ring has an upper and lower surface and is supported such that the lower surface is spaced above the playing board upper surface a distance greater than X and less than Y providing a circumferential slot between the playing surface and the top ring lower surface, the slot being of a height so that target marbles may pass through but taws can not pass through.

A marble guide is supported below the playing board and top ring. The guide is of generally frusto-conical configuration providing a downwardly inclined upper surface converging to a central opening so that marbles passing through the circumferential slot roll downwardly on the marble guide and out the central opening.

A marble collection box is positioned below the marble guide central opening and receives the target marbles passing through the circumferential slot so that the target marbles may be recovered for replay. A coin-operated door may be placed on the marble collection box so that the target marbles necessary for replay can be removed only by first inserting a coin.

The top ring is preferably covered on the top surface thereof by foam padding and serves to provide an area wherein a player can rest his hand when shooting a taw onto the playing surface. The playing surface should be approximately table height and the diameter of the playing surface and top ring may vary. As an example, a typical playing board may be approximately 48 inches in diameter and the outer diameter of the upper ring approximately 59 inches with the diameter of the inner ring being approximately 47 inches.

A better understanding of the invention will be had by reference to the following description and claims, taken in conjunction with the attached drawing.

DESCRIPTION OF A PREFERRED EMBODIMENT

Figure 1:
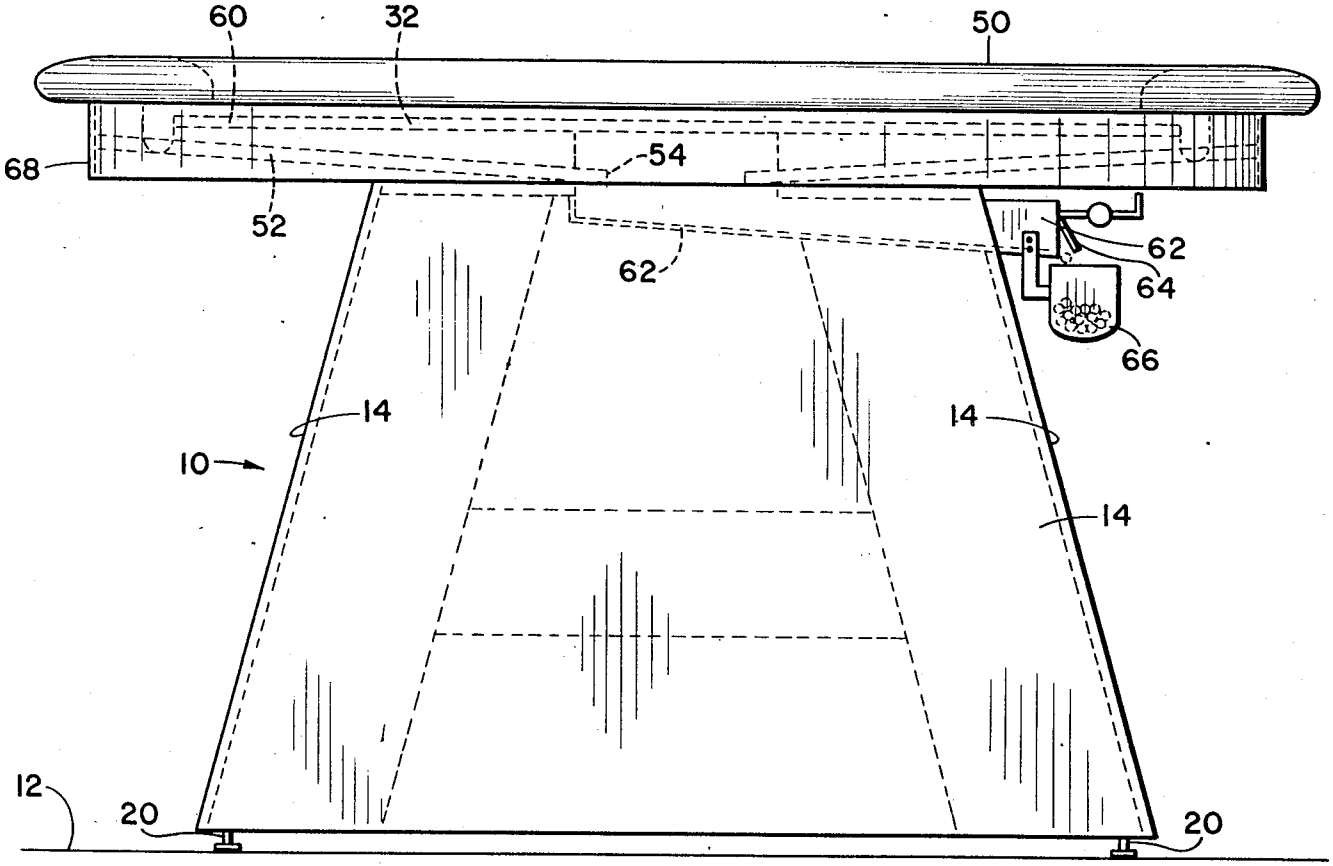
FIG. 1 is an elevational view of a table for playing marble games according to the invention.

Referring to the drawings, a base portion is generally indicated by the numeral 10 which provides support for the playing table above a floor surface 12. The base 10 may be of a variety of configurations but is illustrated as being formed of four upwardly and inwardly inclined sidewalls 14, which may be formed such as of plywood, and providing an upper base top 16 having a base upper horizontal surface 18. The base 10 includes levelers 20 so that the playing surface, which will be described subsequently, can be accurately adjusted to be horizontal.

Figure 3:
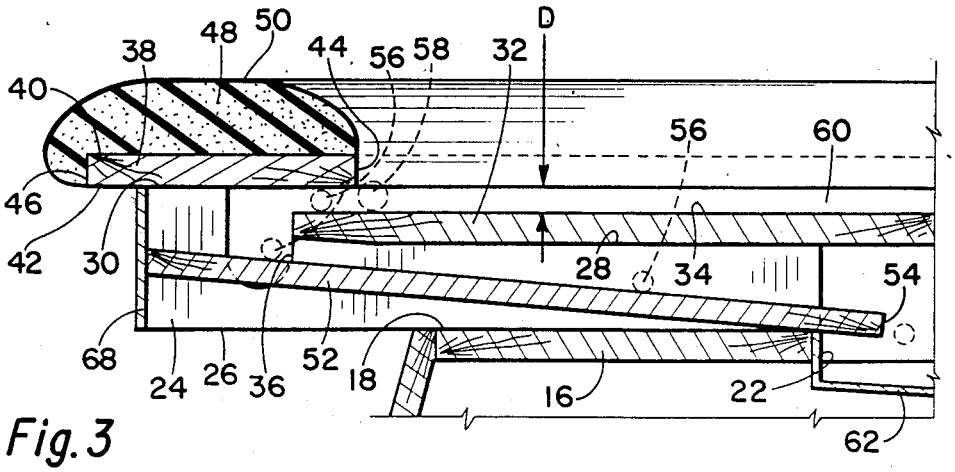
FIG. 3 is a partial cross-sectional view taken along the line 3—3 of FIG. 2.

The base top 16 has a central opening 22 therein. Positioned on the base top are eight radially extending vertical supports 24. Each vertical support has a lower edge 26 and an upper edge divided in two parts, the inner part being indicated by the numeral 28 and the outer part by the numeral 30 (See FIG. 3).

Positioned on the vertical support's upper inner edges 28 is a playing board 32 having an upper playing surface 34. The playing board 32 is circular having an outer circumferential edge 36.

A top ring 38 is supported on the vertical support's upper edge outer portion 30. The top ring has an upper horizontal surface 40 and a lower horizontal surface 42. The top ring lower surface 42 is spaced above the playing board upper surface 34 a distance D.

The top ring has a inner diameter 44 and an outer diameter 46. The inner diameter 44 is less than the outer diameter 36 of the playing board. Foam padding 48 is placed on the top ring upper surface 40 and over the outer circumferential edge 46. A flexible covering 50, such as of plastic, covers the foam padding 48.

Spaced between each of the vertical supports 46 are pie-shaped marble guide boards 52. Each of the guide boards is downwardly inclined towards the center leaving a central opening 54. The marble guide boards 52 together with the vertical support 24 form a generally frustoconical marble guide means supported below the playing board 32.

The table is designed for use in playing marble games which include two diameters of marbles, that is, a smaller diameter target marble indicated by the numeral 56, which may be such as ½ inch in diameter, and a larger diameter shooter or taw indicated by the numeral 58 which may be of a diameter of ¾ inch. The spacing D between the top playing surface 34 and the lower edge 42 of the top ring is intermediate these diameters and may be such as ⅝ inch. In this way the target marbles 46 are free to pass through the annular slot 60 formed between the playing surface 34 and the top ring bottom surface 42. When a target marble 56 passes through slot 60 it falls downwardly onto the marble guide boards 52 and is guided downwardly through opening 54.

Figure 2:
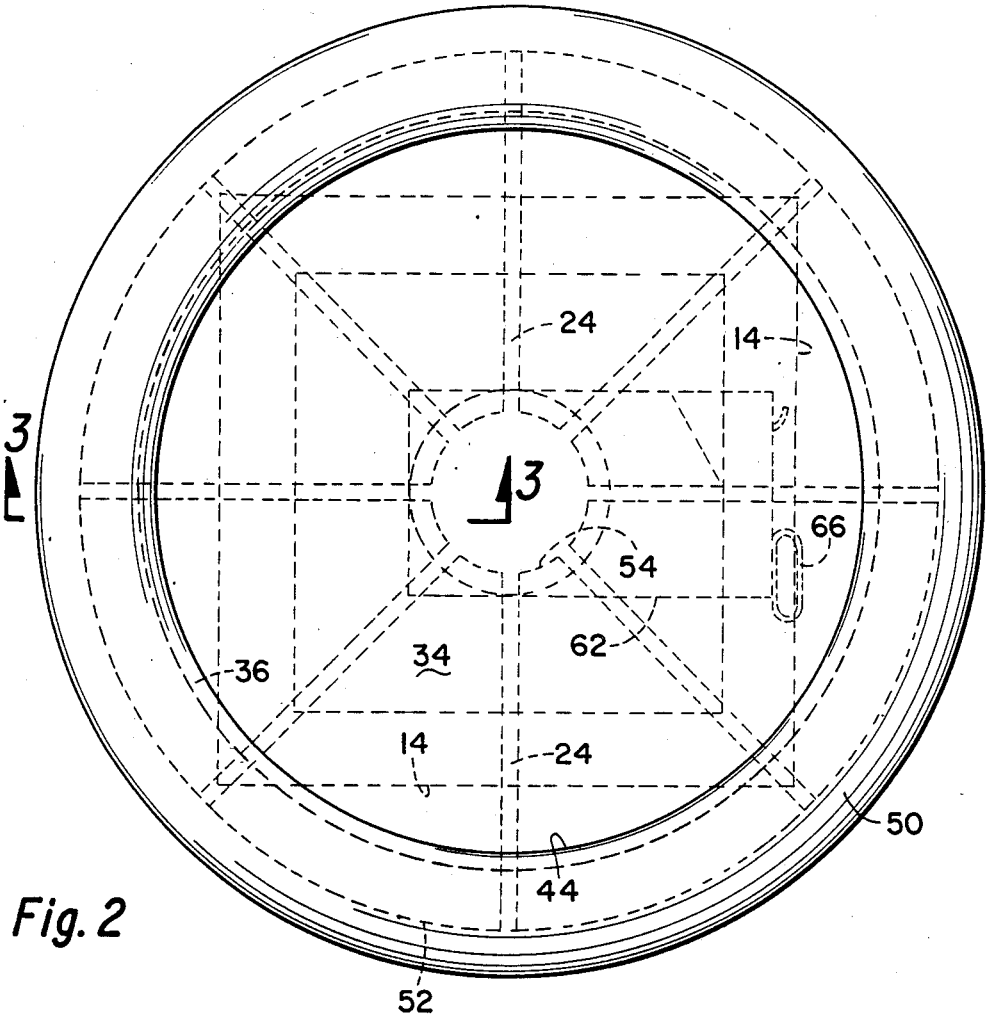
FIG. 2 is a top view of the playing table of FIG. 1.

Positioned in the opening 22 in the base top 16 is a collector box 62. The collector box may be, as indicated in FIGS. 1 and 2, rectangular with a portion of the collector box extending below the lower edge of the vertical supports 24 and towards one edge of the playing table. The collector box may include a coin-operated door 64 so that in order to retrieve the target marbles which have been knocked off of the playing surface a coin must be used to open the door 64, allowing the target marbles to enter into a collection cup 66 wheren they may be returned to the top of the playing surface.

A skirt 68 is positioned around the outer ends of the vertical supports 24 and marble guide boards 52 to enclose the outer portion of the marble guide and to provide a finished look for the playing table.

As previously indicated, the table should be of approximately table height above the floor 12 so that users can play the marble game without getting down on their hands and knees as is the case when games are played on the earth's surface. This makes the game much more convenient and enjoyable and adapts the game for indoor use for people of all ages. Various games may be played by established rules or the players can make up their own rules. A typical game requires a player to knock the other players' target marbles off the table using his taw and in which the taw is shot from the padded top surface of the top ring initially and thereafter shot from the position where it stops on the table. The game is expedited in that the taw is prevented from entering the circumferential slot 60 so as to always remain on the table.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A table for playing marble games thereon employing target marbles of diameter X and taws of diameter Y where Y is greater than X, the table comprising:

a base having a horizontal top surface;

a circular horizontal playing board supported above said base top surface and providing an upper playing surface;

a circular horizontal top ring supported concentrically above said playing board and of interior diameter less than the diameter of said circular playing board and of exterior diameter greater than said circular playing board and having an upper and a lower surface, the lower surface being spaced above said playing board upper surface a distance greater than X and less than Y providing a circumferential slot between said playing surface and said top ring lower surface;

marble guide means supported below said playing board and said top ring, the guide means being of generally frusto-conical configuration providing a downwardly inclined upper surface to a central opening whereby marbles passing through said circumferential slot roll downwardly on said marble guide means and out the central opening;

a plurality of radially positioned vertical supports each having an upper and a lower edge, the lower edge being supported on said base top surface and the upper edge being configured to support said playing board and said top ring, and wherein said marble guide means is in the form of a plurality of pie-shaped marble guide boards positioned between the vertical supports; and a marble collection box positioned below said marble guide means central opening for receiving the target marbles passing through said circumferential slot whereby the target marbles may be recovered for replay.

2. A table for playing marble games thereon according to claim 1 including:

a coin operated door to said marble collection box.

3. A table for playing marble games thereon according to claim 1 including:

foam padding on the upper surface of said top ring.

* * * * *